United States Patent [19]

Oven et al.

[11] 4,367,898

[45] Jan. 11, 1983

[54] EXCAVATING MACHINES FOR TUNNELING WITH TEMPLATE FIXED TO BOOM

[75] Inventors: Terence Oven; Robert H. Higgs, both of Burton-on-Trent, England

[73] Assignee: Coal Industry (Patents) Limited, London, England

[21] Appl. No.: 221,364

[22] Filed: Dec. 29, 1980

[30] Foreign Application Priority Data

Jan. 25, 1980 [GB] United Kingdom ..... 8002606

[51] Int. Cl.[3] ..... E21D 9/10

[52] U.S. Cl. ..... 299/1; 33/174 G

[58] Field of Search ..... 299/1, 75; 33/181 R, 33/174 G, 174 R

[56] References Cited

U.S. PATENT DOCUMENTS 4,027,210 5/1977 Weber ..... 299/1 X
4,033,626 7/1977 Dinkelbach ..... 299/1

FOREIGN PATENT DOCUMENTS 808208 of 0000 United Kingdom .
1340772 of 0000 United Kingdom .
1472590 of 0000 United Kingdom .
1477974 of 0000 United Kingdom .
1488489 of 0000 United Kingdom .
1496819 of 0000 United Kingdom .
1541709 of 0000 United Kingdom .
592981 2/1978 U.S.S.R. ..... 299/1

*Primary Examiner*—Ernest R. Purser
*Attorney, Agent, or Firm*—Stevens, Davis, Miller & Mosher

[57] ABSTRACT

An excavating machine for excavating rock or mineral to extend an underground roadway or tunnel comprises a mobile carriage provided with a support assembly for a pivotally-mounted cutter carrying boom. In addition, the machine comprises an indication mechanism mounted on either the carriage or support assembly and including a cutter-position indicator for indicating the position of the boom-mounted cutter, the cutter position indicator co-operating with a template defining a reduced scale profile of the roadway or tunnel cross-section, the template being mounted for movement with the boom.

10 Claims, 3 Drawing Figures

EXCAVATING MACHINES FOR TUNNELING WITH TEMPLATE FIXED TO BOOM

This invention relates to excavating machines for excavating rock or mineral to extend an underground roadway or tunnel.

In particular, although not exclusively, the present invention relates to an excavating machine including a carriage, a support assembly mounted on the carriage, a forwardly directed cutter-carrying boom pivotally mounted on the support assembly, and a driven rotary cutter on the end of the boom remote from the support assembly. One problem frequently encounted by an operator of such a known machine is that during cutting the cutter is remote and it is difficult to control precisely the position of the cutter with respect to the cross-sectional area of the roadway or tunnel. Consequently, in order to ensure adequate rock or mineral is extracted to permit installation of roof supports along the roadway or tunnel the operator tends to over-cut the working face leading to voids being left between the installed roof supports and the adjacent strata. The control of the cutter position tends to be made worse by dust generated during cutting which can mask the cutter from the operator.

An object of the present invention is to provide an improved excavating machine which tends to overcome or reduce the above mentioned problem.

According to the present invention an excavating machine for excavating rock or mineral to extend an underground roadway or tunnel, comprises a carriage moveable along the roadway or tunnel, a support assembly mounted on the carriage, a cutter-carrying boom pivotally supported on the support assembly, ram means for controlling pivotal movement of the boom, a control panel including means for controlling pivotal movement of the boom, mechanism including a cutter-position indicator for indicating the position of a cutter which, in use, is mounted on the boom remote from the support assembly, the mechanism being mounted on the carriage so as to co-operate with a template defining a reduced scale profile of the roadway or tunnel cross-section, the template being mounted for movement with the boom.

Conveniently, the template comprises a screen defining the reduced scale profile pictorially, the cutter-position indicator being viewed with respect to the screen.

Alternatively, the template is formed to define the reduced scale profile, the cutter-position indicator being arranged to abut the template.

Preferably, the template is part spherical.

Advantageously, the position of the cutter-position indicator is adjustable.

Conveniently, the cutter-position indicator is slidably mounted relative to the carriage.

Preferably, the template is mounted at the end of the boom remote from the cutter carrying end of the boom.

By way of example only, one embodiment of the present invention will now be described with reference to the accompanying drawings, in which.

Figure 1:
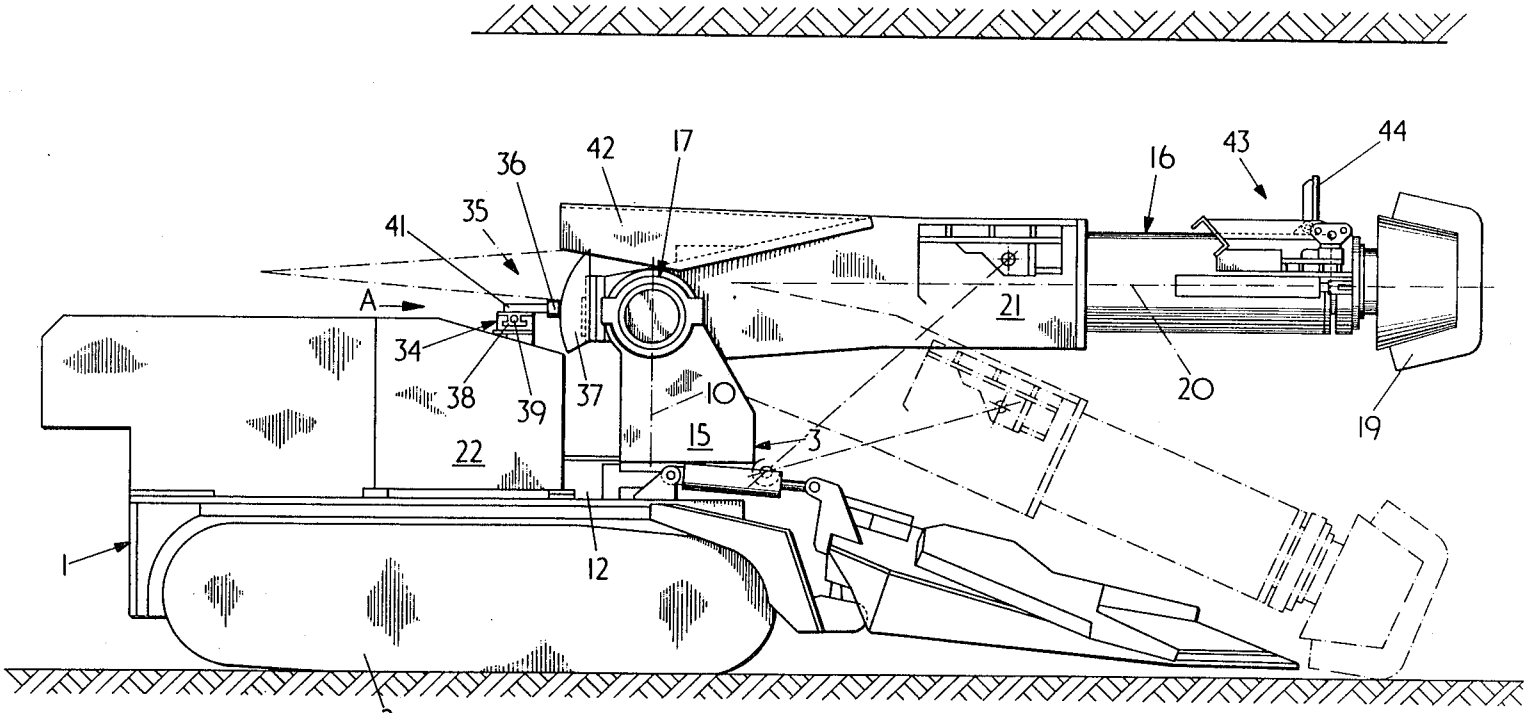
FIG. 1 is an incomplete side elevation of an excavating machine constructed in accordance with the present invention.
Figure 2:
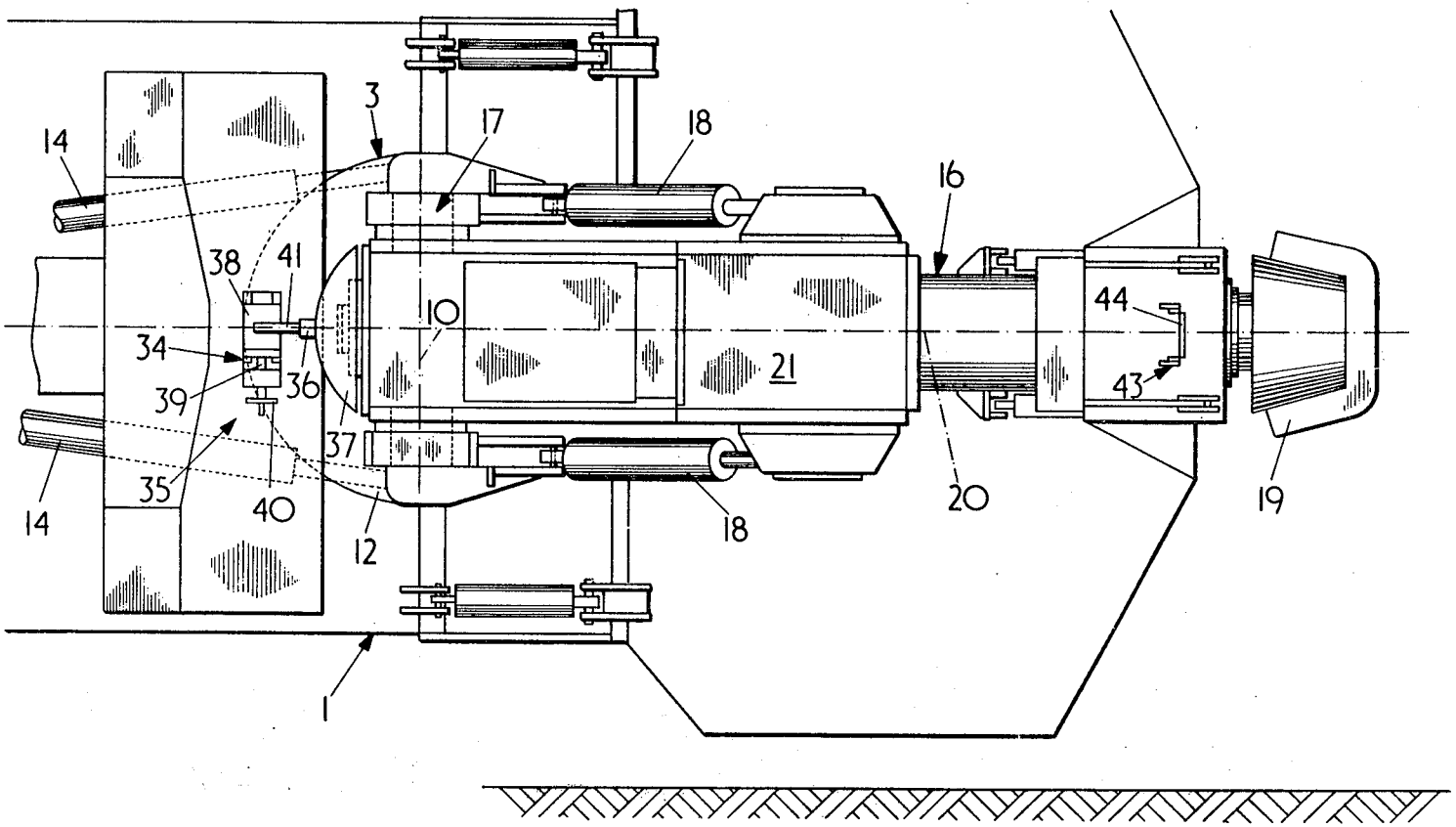
FIG. 2 is an incomplete plan of FIG. 1.

The drawings show an excavating machine comprising a floor mounted carriage 1 having crawler tracks 2 for advancing the machine along an underground roadway or tunnel towards a working rock or mineral face. A support assembly 3 is rotatably mounted on the carriage for pivotal movement about a generally vertical axis 10, the support assembly including a slew ring 12 rotatable under the control of hydraulic rams 14 mounted between the carriage and the slew ring.

The support assembly provides a turret 15 pivotally supporting a forwardly directed, cutter-carrying boom 16 in a pivotal mounting 17, pivotal movement of the boom about the mounting 17 being controlled by a pair of hydraulic rams 18 mounted between the support assembly and the boom. A rotary cutter 19 is mounted on the end of the boom remote from the support assembly, the cutter being rotatably driven about the longitudinal axis 20 of the boom by a drive motor housed within a housing 21 carried by the boom.

A control panel 22 including a valve means for controlling pivotal movement of the boom is mounted on the carriage 1 adjacent to the rear of the support assembly.

The excavating machine also comprises an indication mechanism 35 including a cutter position indicator 36 for indicating the position of the cutter 19 as the boom is moved relatively to the carriage about the pivotal mountings 10 and 17.

During cutting the indicator 35 is normally fixed relatively to the carriage 1 and is arranged to co-operate with a template 37 defining a reduced scale profile of the roadway or tunnel cross-section, the template being fixedly mounted on the end of the boom remote from the cutter 19 for movement with the boom.

Figure 3:
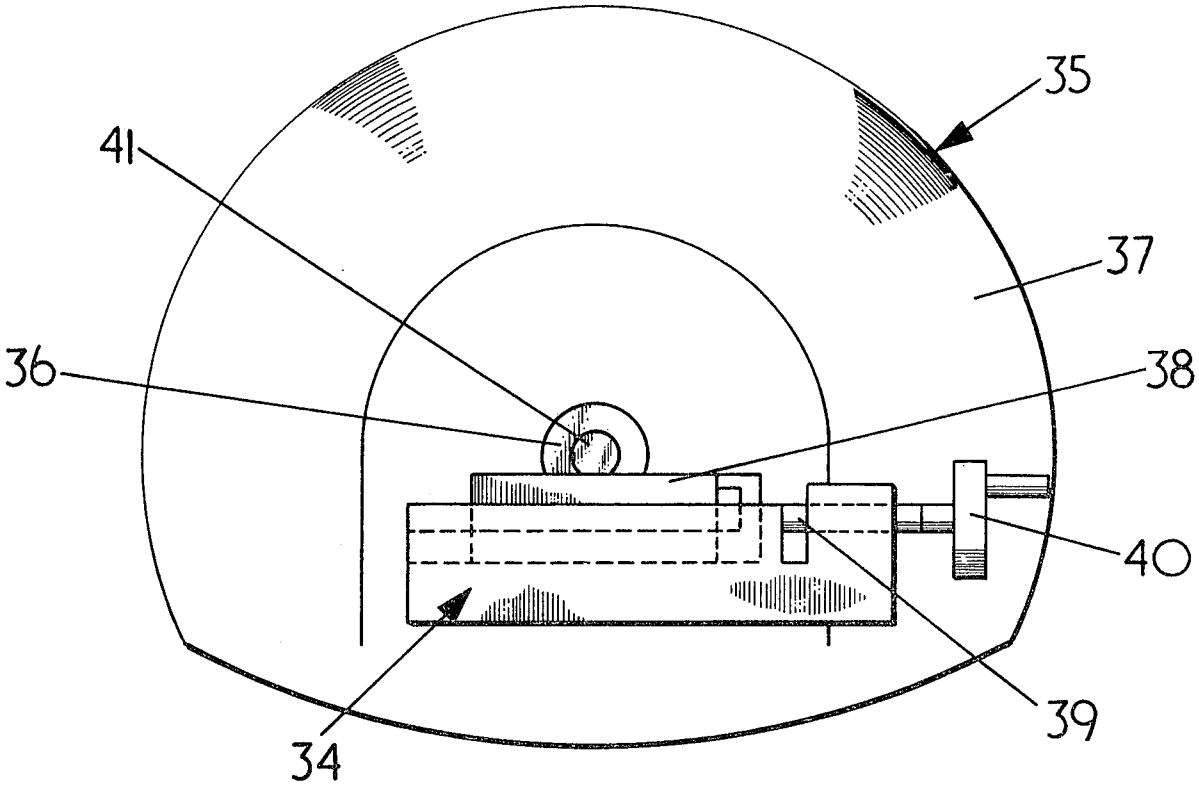
FIG. 3 is a scrap view of a detail of FIG. 1 as seen in the direction of arrow A.

As seen in the drawings the template comprises a part spherical screen defining pictorially (see FIG. 3) a reduced scale profile of the roadway or tunnel cross-section. Typically, the screen presents an opaque outer margin representing strata adjacent to the roadways or tunnel and a contrasting clear inner region represents the roadway or tunnel cross-section, an operator sitting at the control panel views the cutter-position indicator through the clear inner region to determine the position of the actual cutter 19 relative to the working face. Thus, the operator can control pivotal movement of the boom following the path of the cutter position indicator relative to the template. Consequently, problems associated with over or under cutting of the roadway or tunnel boundary substantially tend to be eliminated or reduced.

If desired several pictorial representations of the roadway or tunnel cross-section can be provided on the template, each representation representing a different size or shape of roadway or tunnel cross-section.

The mechanism 35 including the cutter-position indicator 36 comprises a slide arrangement having a slideway component 34 fixedly mounted with respect to the carriage 1 and defining a generally horizontally slideway extending transversely to the longitudinal axis of the boom and a slide component 38 the position of which is adjustable along the slideway under the action of a screw attachment 39 provided with a manual handle 40. A forwardly projecting element 41 extending from the slide component 34 supports the cutter position indicator 36.

The excavating machine also comprises a guard 42 provided on the boom and extending over the mechanism 35. In addition, the excavating machine comprises site means 43 comprising a hinged flap 44 defining a target for a laser beam (not shown) which as will be explained later in this specification is used initially to align the machine in the roadway and subsequently to maintain the roadway or tunnel on a preselected desired path.

In operation, the machine is installed in the roadway or tunnel to be extended and laser equipment set up to direct a laser beam in a direction along the centre-line of the proposed roadway or tunnel. The position of the forwardly directed boom then is adjusted such that the target of the site means 43 is aligned with the laser beam. The boom then is retained in the aligned position while the screw attachment 39 is actuated to move the slide component 34 along the slideway to suitably adjust the position of the cutter position indicator such that it likes on the centre-line provided on the template.

Once the cutter position indicator 36 is initially aligned with the centre-line of the template, the screw arrangement is not adjusted further unless a recalibration is required.

After the setting up procedure is complete the operator follows movement of the cutter 19 within the roadway or tunnel cross-section by observing the cutter position indicator 36 with respect to the profile on the template.

From the above description it will be seen that the present invention provides a simple, robust, safe and acceptably accurate equipment for following a boom mounted cutter on an excavating machine.

In other embodiments of the invention the cutter position indicator may comprise a light or laser beam arranged to co-operate with the screen provided by the template, the beam representing the cutter position.

In further embodiments the template may be cut to define the reduced scale profile of the roadway or tunnel cross section, the cutter position indicator being arranged to abut the cut profile when the cutter approaches the desired roadway or tunnel boundary. Such an embodiment may include means to stop or restart further outward movement of the boom when the cutter position indicator abuts the cut profile.

In still further embodiments of the invention sensor means are provided for sensing the position of the cutter position indicator with respect to the profile defined by the template. Such sensor means may derive a signal indicative of the cutter position with respect to the cross-section of the roadway or tunnel. In such embodiments the derived signal may be fed to boom position control means which control the position of the boom in response to the received indicative signal.

We claim:

1. An excavating machine for excavating rock or mineral to extend an underground roadway or tunnel, comprising a carriage moveable along the roadway or tunnel, a support assembly mounted on the carriage, a cutter-carrying boom pivotally supported on the support assembly, ram means for controlling pivotal movement of the boom, a control panel including means for controlling pivotal movement of the boom, an indication mechanism including a cutter-position indicator for indicating the position of the cutter, said indicator being mounted on either the support assembly or the carriage so as to be fixed relative to said boom; a template adjacent the indicator and defining a reduced scale profile of the roadway or tunnel cross-section, the template being mounted for movement with the boom so that the template moves in relation to the indicator.

2. A machine as claimed in claim 1, in which the template comprises a screen defining the reduced scale profile pictorially, the cutter-position indicator being viewed with respect to the screen.

3. A machine as claimed in claim 2, in which the template is formed to define the reduced scale profile, the cutter-position indicator being arranged to abut the template.

4. A machine as claimed in claim 3, in which the template is part spherical.

5. A machine as claimed in claim 1, in which the position of the cutter-position indicator is adjustable.

6. A machine as claimed in claim 5, in which the cutter-position indicator is slideably mounted relatively to the carriage.

7. A machine as claimed in claim 1, in which the template is mounted at the end of the boom remote from the cutter carrying end of the boom.

8. A machine as claimed in claim 1, comprising sensor means for sensing the position of the cutter position indicator with respect to the profile defined by the template.

9. A machine as claimed in claim 8, in which the sensor means derives a signal indicative of the cutter position with respect to the cross section of the roadway or tunnel.

10. A machine as claimed in claim 9, in which the derived signal is fed to boom position control means which control the position of the boom in response to the received indicative signal.

* * * * *